US008464625B2

(12) United States Patent
Polovnev et al.

(10) Patent No.: US 8,464,625 B2
(45) Date of Patent: Jun. 18, 2013

(54) BARREL-MOUNTED DEVICE FOR A FIREARM

(75) Inventors: Andrey Albertovich Polovnev, Moscow (RU); Volodymyr Shaymukhametovich Khasiakhmetov, Kharkov (UA)

(73) Assignee: DSG Technology AS, Lorenskog (NO)

( * ) Notice: Subject to any disclaimer, the term of this patent is extended or adjusted under 35 U.S.C. 154(b) by 0 days.

(21) Appl. No.: 12/746,173

(22) PCT Filed: Oct. 15, 2008

(86) PCT No.: PCT/RU2008/000654
§ 371 (c)(1),
(2), (4) Date: Jun. 3, 2010

(87) PCT Pub. No.: WO2009/072925
PCT Pub. Date: Jun. 11, 2009

(65) Prior Publication Data

US 2010/0275493 A1 Nov. 4, 2010

(30) Foreign Application Priority Data

Dec. 3, 2007 (RU) ..... 2007144551

(51) Int. Cl.
*F41A 21/34* (2006.01)

(52) U.S. Cl.
USPC ..... 89/14.2

(58) Field of Classification Search
USPC ..... 89/14.1–14.4; 42/1.06
See application file for complete search history.

(56) References Cited

U.S. PATENT DOCUMENTS

| | | | |
|---|---|---|---|
| 2,503,491 | A | 4/1950 | Janz |
| 2,780,962 | A | 2/1957 | Ressler |
| 5,136,923 | A | 8/1992 | Walsh, Jr. |

FOREIGN PATENT DOCUMENTS

| | | | |
|---|---|---|---|
| RU | 2124170 | C1 | 12/1998 |
| RU | 2202751 | C2 | 4/2003 |

OTHER PUBLICATIONS

PCT/RU2008/000654 International Search Report (Feb. 12, 2009).

*Primary Examiner* — Michael Carone
*Assistant Examiner* — Reginald Tillman, Jr.
(74) *Attorney, Agent, or Firm* — John B. Hardaway, III; Nexsen Pruet, LLC

(57) ABSTRACT

The invention relates to rifled and smoothbore firearms and can be used in barrel-mounted devices for firing in the air and in the water. The inventive barrel-mounted device for firearms comprises a unit for joining to the barrel, a cap and a starting part with gas vents. The starting part bore is the continuation of the barrel bore, and there are N≧1 compartments formed between the casing and the starting part. Each compartment includes at least two gas vents and provides the possibility of gas exhaust from the starting part bore to the compartment through the first of the mentioned gas vents and gas exhaust from the compartment to the starting part bore through the second gas vent. The compartment length is 0.5-3.0 of the bore caliber and in the cross-section plane of the barrel-mounted device the minimal cross-section area of N≧1 compartments, designed for the gas flow between gas vents, ranges within 0.4-4.5 of the barrel bore area. The barrel-mounted device can comprise a muzzle compartment, which projects beyond the muzzle face of the starting part and has a front wall with a muzzle opening. The diameter of the muzzle opening equals to 1.05-1.2 of the barrel bore caliber. The said invention makes it possible to reduce recoil momentum, shot blast and muzzle flash while firing in the air, as well as to reduce recoil momentum and hydraulic impact in the course of underwater firing.

20 Claims, 4 Drawing Sheets

BARREL-MOUNTED DEVICE FOR A FIREARM

CROSS-REFERENCE TO RELATED APPLICATIONS

This U.S. National Stage Application arises from PCT/RU2008/000654, filed 15 Oct. 2008, which itself claims priority to RU 2007144551, filed 03 Dec. 2007.

TECHNICAL FIELD

The invention relates to barrels of rifled and smoothbore firearms, or more specifically, to barrel-mounted devices designed for reducing recoil momentum, shot blast and muzzle flash while firing in the air, and for reducing recoil momentum and hydraulic impact in the course of underwater firing.

PRIOR ART

The need of creating barrel-mounted devices arises from the fact that the use of powerful ammunition in modern firearms while firing in the air results in the increase of recoil momentum, muzzle flash and shot blast, affecting the weapons and the shooter and thus reducing the results of firing. In the course of underwater firing with underwater ammunition from sporting and hunting guns and small arms (see Description to patent RU 2316718 C1 Int. C1.[7] F42B 10/42 of 10, Feb. 2008; International Application PCT/RU2007/000068 of 12, Feb. 2007, publication No. WO 2007/126330 of 8, Nov. 2007; European Patent Application 07747813.9 of 12, Feb. 2007, publication No. EP 2053342 A1 of 29 Apr. 2009; the U.S. patent application Ser. No. 12/298,536 of 26 Oct. 2008, publication No. US 2009/0064888 A1 of 12, Mar. 2009 and Norwegian Patent Application 20084978 of 27 Nov. 2008), hydraulic impact and recoil momentum increase. These phenomena may be undesirable as they have an effect on the shooter and reduce the accuracy of aim and of fire in Aqua Shooting Ranges (see Description to patent RU 2316712 C2 Int. C1.[7] F41J 1/18 of 10, Oct. 2008; European Patent Application 06757944.1 of 3, May 2006, publication No. EP 1884736 A2 of 6, Feb. 2008; the U.S. patent application Ser. No. 11/913,531 of 2, Nov. 2007, publication No. US 2008/0258396 A1 of 23 Oct. 2008 and Norwegian Patent Application 20076207 of 3, Dec. 2007).

In the known barrel-mounted devices of a positive, passive reaction or heat exchange type the power of powder gases is used, the exhaust speed of which at free expansion (U=1800-2400 m/s) is much higher than the muzzle velocity of a bullet or a projectile (V=250-1450 m/s). Those known barrel-mounted devices comprise a starting part and an outer casing, the clearance between them forming one or several compartments separated by walls and partitions longitudinally and/or transversally. The bore of the starting part is the continuation of the barrel bore, as powder gases continue to accelerate a bullet or a projectile in it. The starting part comprises gas vents through which the gas flow exhausts to the compartments. The casing may have gas openings through which the gas exhausts from the compartments to the environment (hereinafter the terms "vent" and "opening" are used). The impact of the gas flow on the walls of the vents and openings, as well as on the walls and partitions of the compartments reduces recoil momentum. Partial cooling of the gas in the compartments reduces shot blast and muzzle flash.

A barrel-mounted device of a positive muzzle brake type is known, which comprises a unit for joining to the barrel, a casing, a starting part with gas vents and two compartments (see Description to U.S. Pat. No. 7,143,680 B2, Int. C1.[7] F41A 21/00, published on 5, Dec. 2006). The bore of the starting part is the continuation of the barrel bore. For a free flight of a bullet the diameter of the starting part inner bore is larger than the barrel bore caliber. The vents are arranged in rows of two vents each. The dimensions and the slope angle of the vents can change along the length of the starting part. The casing has gas openings, which partially lap over the vents of the starting part. This device is fixed with a clamp and fasteners. On firing, the gas flow exhausts through the starting part vents into the compartments, and through the casing openings it outflows into the environment. The impact of the gas flow on the front walls of the vents reduces recoil momentum, and an incomplete slowdown of the gas flow in the compartments due to a partial overlap of vents by the casing partially reduces shot blast and muzzle flash.

However, in the course of firing in the air, gases exhausting from the compartments in the radial (lateral) direction from the line of fire increase the shot blast affecting the shooter. The latter is not able to counteract either the increase of the vents dimensions towards the muzzle face, or a partial overlap of vents by the casing. In the course of underwater firing the exhaust gases and the water, expulsed from the barrel, flow out of the compartments in the radial (lateral) direction from the line of fire and intensify the hydraulic impact, which affects the shooter. Fixing of this device on the barrel with a clamp cannot provide an exact fit of the barrel bore and the starting part bore and results in the fire accuracy decrease.

A barrel-mounted device of a positive-passive muzzle brake type is known, which comprises a unit for joining to the barrel, a casing with gas openings, a starting part with gas vents and one compartment (see Description to U.S. Pat. No. 5,814,757, Int. C1.[6] F41A 21/00, published on 29 Sep. 1998). The starting part bore is the continuation of the barrel bore. The vents are arranged in transversal rows and offset relative to the casing openings. The vents and openings are in the form of cylindrical apertures, their slope angle to the longitudinal axis of the bore, measured from the side of the device muzzle face, being 70-85 degrees. This device has a threaded joint with the barrel and is fixed by a screw. On firing, the gas flow exhausts from the vents and openings into the environment. Moreover, the gas has an impact on the walls of the vents and openings, changes the direction and produces jet thrust thus reducing recoil momentum. Incomplete cooling of the gas in the compartment due to the offset of the vents relative to the openings and partial redirection of the gas towards the target partially reduces shot blast and muzzle flash.

However, in the course of firing in the air, gases exhausting from the compartment in the radial (lateral) direction from the line of fire increase the shot blast affecting the shooter. The latter is not able to weaken a partial redirection of the gas towards the target. In the course of firing under the water the exhaust gases and the water, expulsed out of the barrel, outflow in the radial (lateral) direction from the line of fire and intensify the hydraulic impact, which affects the shooter.

A barrel-mounted device of a heat exchange muzzle brake type is known, which comprises a unit for joining to the barrel, a starting part with gas vents and a casing with compartments (see Description to patent RU 2202751 C2, Int. C1.[7] F41A 21/32, published on 20 Apr. 2003). This device has a threaded joint with the barrel. For a free flight of a bullet the diameter of the starting part bore is larger than the barrel bore caliber. The vents of the starting part are in the form of rings, which are conjugated with torus-shaped plenums of compartments. In that known patent it is expected that the gas should swirl in torus-shaped plenums of compartments, change its direction and decelerate the gas, which follows the bullet.

However, according to the laws of gas dynamics and weapon ballistics, a gas conduit (input and output) is necessary to change the direction of a gas flow. Therefore gases exhausting with the velocity of U=1800-2400 m/s cannot change the direction in closed compartments and in the course of firing in the air gases will evenly fill those closed compartments. Low efficiency of this device is caused by the fact that the decrease of shot blast and muzzle flash will be proportional only to the ratio of the compartments and the barrel bore volumes. In the course of underwater firing the compartments will be filled with water, and the gas will not be able to push water out of closed compartments.

The closest analog (prototype) of this claimed invention is a barrel-mounted device of a heat exchange muzzle brake type, which comprises a unit for joining to the barrel, a casing, a starting part with gas vents and one or several compartments (see Description to U.S. Pat. No. 5,136,923, Int. C1.[5] F41A 21/00, published on Nov. 8, 1992). The starting part bore is the continuation of the barrel bore. The vents are arranged in transversal rows and are in the form of cylindrical apertures, their diameter being more than 0.5 of the barrel bore diameter. The slope angle of the vents to the longitudinal axis of the bore, measured from the side of the device muzzle face, can be 30-60 degrees. Transversal walls of the compartments are designed for fixing porous material, which may be placed there. Relative position of the starting part vents and transversal compartment walls is not provided for. This device has a threaded joint with the barrel. When a bullet passes the starting part vents, the gas fills the compartments and is partially cooled. Gas impact on the front walls of the vents slightly reduces recoil momentum. When there are several compartments and porous material, the powder gas exerts additional effect on the transversal walls of the compartments and is cooled in the porous material. On firing, the gas exhausts from the compartment to the starting part through the vents and leaves this device; that reduces shot blast and muzzle flash.

However, gases exhausting to the compartments from the starting part do not reduce recoil momentum efficiently enough. For a more efficient recoil momentum reduction an intensive gas flow is necessary, either in the radial direction from the line of fire or outwards the casing, or from the compartments back to the starting part bore, which is not provided for in this device. At the firing rate of 10-20 rounds per second the effectiveness of this device decreases as the gas has too little time to cool down in the compartments. In the course of underwater firing the barrel and compartments are filled with water but the design of compartments and the location of vents make impossible efficient deceleration of the gases exhausting from the barrel.

SUMMARY OF THE INVENTION

The purpose of the given invention is to increase the effectiveness of barrel-mounted devices for firearms while firing in the air and under the water.

The mentioned purpose is provided by the barrel-mounted device for firearms, which comprises a unit for joining to the barrel, a casing and a starting part with gas vents, and wherein the starting part bore is the continuation of the barrel bore and there are N≧1 compartments between the casing and the starting part, where, pursuant to this invention, each compartment includes at least two gas vents and is adapted to ensure gas exhaust from the starting part bore to the compartment through the first of the mentioned gas vents and gas exhaust from the compartment to the starting part bore through the second gas vent. Moreover, the compartment length is 0.5-3.0 of the bore caliber and in every cross-section plane of the barrel-mounted device intersecting at least one compartment the following condition is met:

$$0,4S_K \le \sum_{i=1}^{M} S_i \le 4,5S_K, \tag{1}$$

where:

$S_K$—is the area of the bore;

$S_i$—is the minimal area of the i-th compartment intended for the gas flow between gas vents;

M—is the number of compartments in the mentioned cross-section plane, 1≦M≦N.

Both in the prior art and in this invention a compartment means an isolated section of the space between the outer surface of the starting part and the inner surface of the casing. When N=1, a compartment means the whole space between the casing and the starting part comprising not less than two gas vents and separated by two longitudinal and/or two transversal walls. When N>1, several isolated compartments are meant, which have at least two gas vents each. Structural units of the casing and the starting part or other elements forming partitions and/or walls can isolate compartments. Compartments can be unequal and be located randomly relative to each other. Walls and partitions can be integral or have perforation and cuts of various forms, and can be oriented along the longitudinal axis of the device, perpendicularly and angularly to it.

Condition (1) substantially means that in every cross-section plane of the device, which intersects one or several compartments, the minimal area of the compartment cross-section designed for the gas flow through gas vents ranges within 0.4-4.5 of the barrel bore area. Basically, the minimal area in this case is understood to be the compartment (compartments) cross-section area without the cross-section area of the gas vents contained in this compartment (these compartments).

The inventive features specified in the independent patent claims allow one to increase the effectiveness of barrel-mounted devices for firearms while firing in the air, or more particularly, to remove muzzle flash, to reduce shot blast and recoil momentum due to the gas-dynamic braking of the gases exhausting from the bore, which takes place in the following way:

- when the base of a bullet or a projectile passes through the first gas vent located in the head part of the compartment, the gases rush to the compartment where they accelerate to the velocity of U=1800-2400 m/s at free expansion;
- when the base of a bullet or a projectile passes through the second gas vent located in the end part of the compartment, the gas rushes from the compartment to the starting part bore through the second gas vent with the velocity of U=1800-2400 m/s and are crossed over by the gas following the bullet or the projectile;
- when the gas flows are crossed over, a gas braking area is formed where the pressure increases and the powder or other fuel burn down faster, and the gases exhausting from the bore collide with the increased pressure zone and rush to the compartment through the first vent;
- when the pressure in the starting part bore decreases due to the further movement of the bullet or projectile, the gas rushes from the compartment to the bore through both vents where it again crosses over the gases exhausting from the bore and slows them down.

The recoil momentum decrease is achieved due to the gas impact on the front walls of gas vents, intensive gas flow in the radial direction from the line of fire, and inertia braking of the gases exhausting from the bore. The shot blast and muzzle flash decrease is achieved due to a more complete combustion of the powder and other fuel and the reduction of the velocity of the gas exhaust from the barrel-mounted device. Moreover, at an intense rate of firing the effectiveness if this device increases, as when the gas expands in the heated compartment, it has more power to slow down the exhaust gases.

The inventive features specified in the independent patent claims allow one to increase the effectiveness of barrel-mounted devices for firearms in the course of underwater firing, or more particularly, to reduce recoil momentum and hydraulic impact due to the gas-dynamic braking of the gases exhausting from the bore, which takes place in the following way:

- when the base of a bullet passes through the first gas vent located in the head part of the compartment, the powder gas rushes to the compartment filled with water where it has enough time to push out part of the water before the bullet blocks the second vent;
- when the base of a bullet passes through the second gas vent located in the end part of the compartment, the gas pushes the rest of the water out of the compartment through this vent and the water jet slows down the gas following the bullet;
- in the gas braking area the pressure increases and powder or other fuel burn down faster, and the gases exhausting from the bore collide with the increased pressure zone and rush to the compartment through the first vent, which is located in the head part of the compartment;
- when the pressure in the starting part bore decreases due to the further movement of the bullet, the gas rushes from the compartment to the bore through both vents where it again crosses over the gases exhausting from the bore and slows them down.

The recoil momentum decrease is achieved due to the water and gas impact on the front walls of gas vents, intensive gas flow in the radial direction from the line of fire, and inertia braking of the gases exhausting from the bore. The decrease of the velocity of the gases exhausting from this device makes it possible to reduce the hydraulic impact, which affects the shooter.

A compartment can include more than two gas vents. However, in this case the effectiveness of the device is improved to a very little degree, though in-between vents increase the amount of the gases exhausting to the compartment. The effectiveness of this device increases in proportion to the increase of the number of compartments with two gas vents by means of repeated hydro- and gas-dynamic braking of the gases exhausting from the bore. Orientation of the gas flow in every compartment improves the effectiveness of this device due to the increase of the velocity of the gas jets, which prevent gas exhaust from the bore. Longitudinal displacement of compartments, which are located in one and the same cross-section plane, relative to each other makes it possible to improve the effectiveness of this device by means of extending the hydro- and gas-dynamic braking zone.

The length of compartments and the minimal area of their cross-section, which is intended for gas and water passing between gas vents, are chosen with regard to the muzzle velocity of a bullet or a projectile, powder charge weight, caliber and length of the barrel, and the environment where the weapons are used. For efficient gas-dynamic and hydrodynamic braking of powder gases the following dimensions are preferable:

- in smooth-bore sporting, hunting and combat shotguns, which are used for firing in the air, the length of each compartment is 0.5-1.6 of the barrel bore caliber, and in every cross-section plane of the barrel-mounted device compartment the minimal area of compartments is 0.5-0.8 of the bore cross-section area. These dimensions are preferable when the muzzle velocity of a bullet (shot) is V=400-500 m/s;
- in short-barrel weapons (pistols and revolvers), which are used for firing in the air and under the water, the length of each compartment is 1.8-2.5 of the barrel bore caliber, and in every cross-section plane of the barrel-mounted device compartment the minimal area of a compartment (compartments) is 0.4-1.5 of the bore cross-section area. These dimensions are preferable when the muzzle velocity of a bullet is V=250-400 m/s;
- in large-caliber weapons, which are used for firing in the air, the length of each compartment is 1.0-1.5 of the barrel bore caliber, and in every cross-section plane of the barrel-mounted device compartment the minimal area of a compartment (compartments) is 1.5-4.5 of the bore cross-section area. These dimensions are preferable when the muzzle velocity of a bullet or a projectile is V=700-1400 m/s;
- in long-barrel weapons, which are used for firing in the air and under the water, the length of each compartment is 1.5-3.0 of the barrel bore caliber, and in every cross-section plane of the barrel-mounted device compartment the minimal area of a compartment (compartments) is 1.5-4.5 of the bore cross-section area. Such a ratio of dimensions makes it possible to increase the gas flow velocity in compartments in the course of firing in the air and to push part of the water out of compartments in the course of underwater firing. This is provided by the fact that the length of the bullet surface gripped in the rifling grooves is 0.9-1.7 of the barrel bore caliber, therefore the lateral surface of the bullet does not block the second row of vents at the beginning of the gas exhaust from the first row of vents, and an open compartment is filled with gases with a higher velocity.

In a particular case the gas vents of the starting part are arranged in transversal rows containing not less than two vents each, and the total area of vents in every row measured from the side of the starting part bore equals to 0.3-1.5 of the barrel bore cross-section area.

This embodiment allows one to increase the effectiveness of the invention due to a symmetrical and intensive hydro- and gas-dynamic braking of the gases exhausting from the bore.

The area of the vents is chosen with regard to the muzzle velocity of a bullet or a projectile, propellant charge weight, caliber and length of the barrel, and the environment where the weapons are used. Moreover, radial and longitudinal stiffness of the starting part and the casing are taken into consideration. Those parts are to be made of strong steel or titanium alloys with the proof strength of $R \geqq 700\ N/mm^2$. The acceptable thicknesses of the barrel-mounted device walls are determined according to the known formulas, which take into account the gas pressure in the device.

For efficient gas-dynamic and hydrodynamic braking of gases the following dimensions are preferable:

- in smooth-bore sporting, hunting and combat shotguns, which are used for firing in the air, the total area of gas vents in every row measured from the side of the starting part bore equals to 0.3-0.7 of the barrel bore cross-section area;

in short-barrel weapons (pistols and revolvers), which are used for firing in the air and under the water, the total area of gas vents in every row measured from the side of the starting part bore equals to 0.4-1.2 of the barrel bore cross-section area;

in large-caliber weapons, which are used for firing in the air, the total area of gas vents in every row measured from the side of the starting part bore equals to 0.8-1.5 of the barrel bore cross-section area.

in long-barrel weapon, which are used for firing in the air and under the water, the total area of gas vents in every row measured from the side of the starting part bore equals to 0.3-1.5 of the barrel bore cross-section area.

In a particular case the barrel-mounted device comprises an additional muzzle compartment with a front wall, which projects beyond the muzzle face of the starting part and has a muzzle opening. The diameter of the muzzle opening equals to 1.05-1.2 of the barrel bore caliber and its longitudinal axis coincides with the longitudinal axis of the starting part bore. Moreover, the muzzle compartment includes at least one gas vent connecting it with the muzzle opening, and the clearance between the muzzle face of the starting part and the front wall with the muzzle opening is less than the caliber of the barrel bore. Moreover, in the cross-section plane of the barrel-mounted device the minimal area of the muzzle compartment cross-section intended for the gas passage from the gas vent or vents to the muzzle face of the starting part ranges within 0.4-4.5 of the barrel bore area.

This embodiment allows one to increase the effectiveness of the invention due to an additional hydro- and gas-dynamic braking of the gases behind the muzzle face of the starting part. In the cross-section plane of the barrel-mounted device the minimal area designed for the gas flow from the gas vents to the muzzle face of the starting part may correspond to the area of the gas passage between the vents in the previous compartments. To exclude intersection of discarding sabots of projectiles and bullets as well as discarding parts of shot shells with the front wall of the compartment, the diameter of the muzzle opening in the compartment is to be 1.05-1.2 of the barrel bore caliber and the clearance between the front wall with the muzzle opening and the muzzle face of the starting part is to be less than the barrel bore caliber.

In a particular case the angle between the gas vents walls and the longitudinal axis of the starting part bore in the axial-longitudinal-section plane of the barrel-mounted device, measured from the side of the muzzle face of the starting part, equals to 30-150 degrees, and in the cross-section plane of the barrel-mounted device the angle between the lateral walls of the vents equals to 30-120 degrees.

This embodiment allows one to increase the effectiveness of the invention due to the orientation of the gas exhaust to and from the compartments and to the increase of the density of the gas flows, which prevent gas exhaust from the barrel bore.

The slope angles of the gas vents walls are chosen with regard to the muzzle velocity of a bullet or a projectile, propellant charge weight, caliber of the barrel bore and for efficient gas-dynamic and hydro-dynamic braking of gases may correspond to the following dimensions:

in the gas vents designed for the gas exhaust from the starting part bore to the compartment, the angle between the vents walls and the longitudinal axis of the starting part bore, measured from the side of the muzzle face of the starting part, equals to 30-90 degrees;

in the gas vents designed for the gas exhaust from the compartment to the starting part bore, the angle between the vents walls and the longitudinal axis of the starting part bore, measured from the side of the muzzle face of the starting part, equals to 90-150 degrees;

in the cross-section plane of the barrel-mounted device the angle between the lateral walls of the gas vents may correspond to the formula $\alpha=360$ degrees/T, where T=3 . . . 9—is the number of vents in each row.

In a particular case each of the mentioned $N \geqq 1$ compartments has at least two cross walls, and one of the at least two gas vents included into the compartment is situated close to the first of the mentioned walls and the second gas vent is situated close to the second of the mentioned walls;

This embodiment allows one to increase the effectiveness of the invention due to a tight restriction of the gas flow between gas vents in the compartment. Moreover, the water and gas effect not only on the front walls of gas vents but also on the front walls of compartments provides additional decrease of recoil momentum.

In a particular case at least one of compartments has two longitudinal walls, which restrict the compartment in the longitudinal direction.

This embodiment allows one to increase the effectiveness of the invention due to the longitudinal orientation of the gas flow between gas vents in the compartment.

In a particular case at least one compartment has a perforated partition placed between the lateral surface of the starting part and the inner lateral surface of the casing. Moreover, in the cross-section plane of the barrel-mounted device the minimal area intended for the gas passage between the outer lateral surface of the perforated partition and the inner lateral surface of the casing ranges within 0.4-4.5 of the barrel bore area.

This embodiment allows one to increase the effectiveness of the invention while firing with large-yield ammunition, as a certain part of the gases is used for a positive hydro-dynamic and/or gas-dynamic braking, and another part—for a passive adiabatic expansion through a perforated partition. As a result, part of the gases leave the barrel-mounted device at a lower velocity, with additional reduction of shot blast and muzzle flash in the air and hydraulic impact in the water.

In a particular case each of the mentioned $N \geqq 1$ compartments has at least two perforated transversal walls, and the barrel-mounted device has the option of closing perforation in the transversal walls of adjacent compartments.

This embodiment allows one to increase the effectiveness of the invention in the devices with short compartments while firing under the water. Partial pushing of water out to adjacent compartments is provided through the perforation of the compartments transversal walls. Moreover, perforation in the transversal walls of compartments can be closed while firing in the air.

In a particular case the barrel-mounted device comprises an additional outer housing with $R \geqq 1$ additional compartments formed between the casing and the outer housing and bounded by walls transversally. Moreover, the lateral surface of the casing has perforation, and in the cross-section plane of the barrel-mounted device the area intended for the gas passage between the outside lateral surface of the casing and the inner lateral surface of the housing ranges within 4.0-8.0 of the barrel bore area.

This embodiment allows one to increase the effectiveness of the invention while firing in the air due to additional adiabatic expansion of a certain gas amount, which fills the enlarged compartment and leaves the barrel-mounted device with a lower velocity thus considerably reducing the sound blast wave. When the muzzle velocity of a bullet is lower than 330 m/sec (lower than the sound velocity in the air), such embodiment makes it possible to provide soundless firing in the air. In the course of underwater firing gases displace a large amount of water from the enlarged compartment to the starting part thus increasing hydrodynamic braking of the gas, which exhausts from the bore, and considerably reducing hydraulic impact.

In a particular case perforation is made in the walls of adjacent compartments of the additional outer housing. Adjacent compartments mean any two compartments, which have a party wall (or a joint section of one of the walls).

This embodiment allows one to increase the effectiveness of the invention due to a partial outflow of gases to adjacent compartments of the housing and additional cooling of gases. In the course of underwater firing partial pushing of water out to adjacent compartments is provided through the perforation of the compartments walls.

In a particular case the longitudinal axis of the additional outer housing is offset relative to the longitudinal axis of the starting part.

This embodiment allows one to increase the effectiveness of the invention in the weapons with a low-set sight leaf, e.g. in pistols, revolvers and smooth-bore shotguns, due to the use of an additional enlarged outer housing, which is biased down and does not extend across the sighting unit.

In a particular case the starting part bore, which is the continuation of the rifled bore, is made smooth and its diameter is equal to 1.01-1.06 of the rifled bore diameter measured at rifling lands.

This embodiment allows one to increase the effectiveness of the invention when used in replaceable muzzle devices of rifled weapons. When the diameter of the starting part smooth bore is equal to 1.01-1.03 of the bore diameter measured at rifling lands, a stabilized travel of a bullet in the starting part bore is provided due to the gripping of its outer surface. Moreover, the angular rate of the bullet rotation acquired in the rifled bore is sustained. When the diameter of the starting part smooth bore is equal to 1.03-1.06 of the bore diameter measured at rifling lands, a free flight of a projectile in the barrel-mounted device is sustained, as the projectile driving band does not touch the inner surface of the starting part bore.

In a particular case the starting part bore has rifling grooves, which are the continuation of the bore rifling grooves, the gas vents being directed along the grooves bottom. Moreover, if the bore has more than five rifling grooves, the number of vents in each row does not exceed half of the grooves and at least half of the grooves are situated between the vents.

This embodiment allows one to increase the effectiveness of the invention when used in replaceable muzzle devices of rifled weapons. Matching of the bore rifling profile with the rifling profile of the starting part bore is performed while mounting the device on the barrel. The gas vents walls are to be matched with the rifling profile. For example, the number of vents in each row should not exceed half of the grooves and the rifling grooves situated between the vents should have a normal profile. All that provides a stabilized travel of a bullet or a projectile in the starting part bore.

In a particular case the starting part is made in the muzzle of a rifled barrel, and the muzzle face of the starting part fits the muzzle face of the barrel.

This embodiment allows one to increase the effectiveness of the invention when used in permanent muzzle devices of rifled weapons where the starting part is made in the muzzle. All that ensures an exact fit of the barrel bore rifling profile and the rifling profile of the starting part bore, and high accuracy of fire and of the shoot without any increase in the weapon dimensions.

In a particular case the starting part bore is made smooth and its diameter is equal to 0.99-1.03 of the smooth bore diameter. Moreover, the starting part can be made in the muzzle of the smooth bore and the muzzle face of the starting part fits the muzzle face of the barrel.

This embodiment allows one to increase the effectiveness of the invention when used in smoothbore shotguns. The starting part can be made in the muzzle or in replaceable muzzle devices to these shotguns. Moreover, in high-grade shotguns and replaceable muzzle devices to them the diameter of the starting part bore is equal to 0.99-1.0 of the bore diameter. In low-grade shotguns the diameter of the starting part bore can be increased up to 1.01-1.03 of the barrel bore diameter.

In a particular case the starting part bore in a smooth-bore weapon can have a muzzle taper, the minimal diameter of which is equal to 0.95-0.98 of the diameter of the starting part bore. Moreover, the muzzle face of the starting part fits the muzzle face of the barrel.

This embodiment allows one to increase the effectiveness of the invention when used in smoothbore shotguns with a muzzle taper, e.g. a choke or a half-choke, which is situated after the gas vents. For effective firing with a bullet or shots the muzzle taper diameter is to be equal to 0.95-0.98 of the diameter of the starting part bore.

In a particular case the casing is multipiece and comprises minimum two elements, each one including at least two gas vents.

This embodiment allows one to increase the effectiveness of the invention when using a multipiece casing design, e.g. in barrel-mounted devices with perforated transversal walls, and makes it possible to close perforation in the walls of adjacent compartments by turning the casing components around the starting part.

In a particular case the starting part is multipiece and comprises minimum two components, which are the continuation of the bore.

This embodiment allows one to increase the effectiveness of the invention when used in a multipiece starting part design, e.g. in smoothbore shotguns with replaceable muzzle devices.

In a particular case the unit for joining the barrel-mounted device comprises a grip with a conical outer surface and with an external thread and has a nut with a conical inner surface. Moreover, the nut is mounted with the possibility of longitudinal movement, impact on the grip conical surface and compressing the grip.

This embodiment in combination with a standard threaded joint makes it possible to use the invention for a secure and quick-detachable mounting of the starting part and/or the casing on the barrel, which is especially important in small arms. When there is no thread on the barrel, this embodiment makes it possible to mount the device on sporting and hunting weapons, and to mount the casing on the starting part, which can be made in the muzzle.

BRIEF DESCRIPTIONS OF THE DRAWINGS

The invention is explained in more detail with actual examples that in no way reduce the volume of claims and are only intended for better understanding of the invention to one of skill in the art.

In the description of specific embodiments of the invention there are references to the accompanying drawings that show the following:

DESCRIPTION OF THE PREFERRED EMBODIMENT

Figure 1:
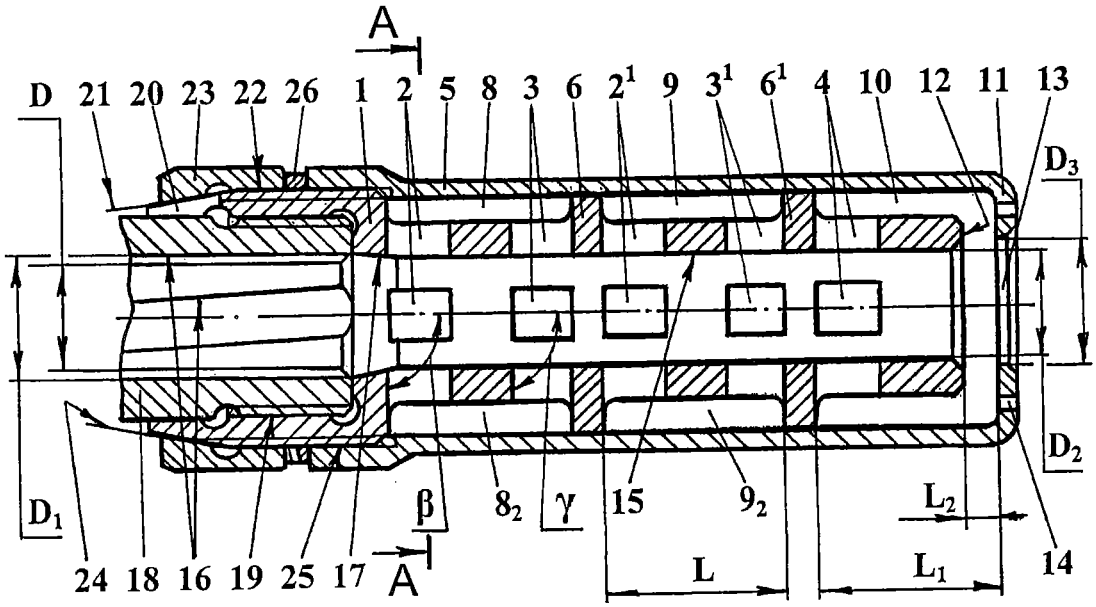
FIG. 1 and FIG. 2 show the first embodiment of the invention in a replaceable barrel-mounted device for a rifled firearm.
Figure 2:
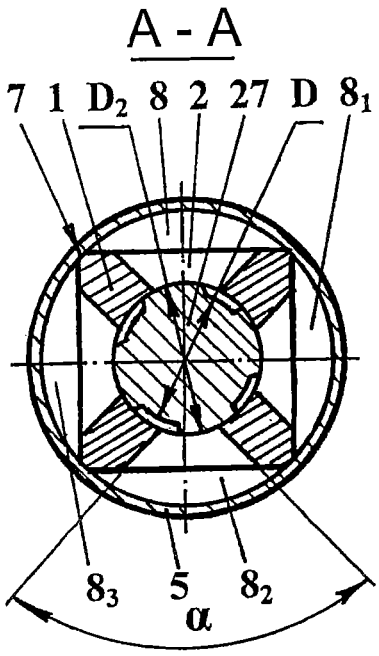

FIG. 1 and FIG. 2 show the barrel-mounted device fixed on a 7.62 mm caliber rifled barrel, where FIG. 1 shows the axial longitudinal section of the device and FIG. 2 shows the cross-section of the device in the A-A plane with a bullet moving in it.

The barrel-mounted device comprises a starting part 1 with twenty gas vents arranged in transversal rows 2, $\mathbf{2}^1$, 3, $\mathbf{3}^1$, 4 and a casing 5 separated by walls 6, $\mathbf{6}^1$ and longitudinal edges 7 of the starting part 1 into eight compartments 8, $\mathbf{8}_1$, $\mathbf{8}_2$, $\mathbf{8}_3$ and 9, $\mathbf{9}_1$, $\mathbf{9}_2$, $\mathbf{9}_3$, and a muzzle compartment 10. The front wall 11 of the muzzle compartment 10 projects over the muzzle face 12 of the starting part 1 and has a muzzle opening 13 and perforation 14. Compartments 8-$\mathbf{8}_3$ and 9-$\mathbf{9}_3$ cover gas vents rows 2, 3, $\mathbf{2}^1$ and $\mathbf{3}^1$ located on the opposite sides of compartments, and the muzzle compartment 10 covers one gas vents row and the muzzle opening 13. The smooth bore 15 of the starting part 1 is an extension of the rifled barrel bore 16 and has a shot seating 17. A unit for joining the starting part 1 to the barrel 18 contains a threaded joint 19 and a grip 20 with a conical outer surface 21 and a nut 23 with a conical inner surface 24 placed on the threaded joint 22. While the nut 23 is tightened, the conical surfaces 21 and 24 are coupled and the grip 20 contracts and connects firmly with the barrel 18. The casing 5 is fixed to the starting part 1 by the threaded joint 25 using an elastic slot washer 26.

In the D=7.62 caliber barrel 18 the diameter of the barrel bore 16 measured along the rifling lands is D=7.62 mm, the diameter of the barrel bore measured along the bottoms of grooves is $D_1$=7.92 mm. The bore comprises four rifling grooves 3.8 mm wide, and the cross-section of the barrel bore has the area of $S_0$=47.6 mm$^2$.

In the starting part 1 the diameter of a smooth bore 15 is $D_2$=1.02 D, and the cross-section of the starting part bore has the area of S=47.4 mm$^2$. These dimensions provide a stable bullet directing in the bore 15, as the outer bullet surface 27 crimps from the diameter $D_1$ to the diameter $D_2$. At the same time, the angular velocity of the bullet rotation obtained in the rifled barrel 16 is kept. The total area of four gas vents in each row 2 or 3, or 4 measured from the side of the bore 15 is $S_1$=1.35 $S_0$. The angle between the walls of gas vents and the longitudinal bore axis is $\beta=\gamma$=90 degrees. The angle between sidewalls of gas vents is $\alpha$=90 degrees. The length of each compartment 8 and 9 is L=1.85 D, and the length of the compartment 10 is $L_1$=1.95 D. The distance from the muzzle face 12 of the starting part 1 to the front wall 11 is $L_2$=0.55 D. In the cross-section plane of the barrel-mounted device the least total area of compartments 8, $\mathbf{8}_1$, $\mathbf{8}_2$, $\mathbf{8}_3$ or compartments 9, $\mathbf{9}_1$, $\mathbf{9}_2$, $\mathbf{9}_3$ design passage between gas vents rows 2 and 3 or $\mathbf{2}^1$ and $\mathbf{3}^1$ is $S_2$=2.1 $S_0$. The muzzle compartment 10 from the wall $\mathbf{6}^1$ of the gas vents row to the muzzle face 12 of the starting part 1 is divided into four segments by longitudinal edges 7. In the cross-section plane of the barrel-mounted device the minimal area of the compartment 10 intended for gas passage from the gas vents row 4 to the muzzle face 12 of the starting part 1 is $S_2$=2.1 $S_0$, and the total area of the perforation 14 on the front wall is $S_3$=0.3 $S_0$. The diameter of the muzzle opening 13 on the front wall 11 is $D_3$=1.15 D.

While firing in the air, the barrel-mounted device works in the following way:

- when the base of a bullet 27 passes through the vents row 2, the gases exhaust to the compartments 8-$\mathbf{8}_3$ and speed up to U=1800-2400 m/s at free expansion;
- when the base of a bullet 27 passes through the vents row 3, the gases from the compartments 8-$\mathbf{8}_3$ are redirected by the wall 6 and rush through the row of vents 3 to the bore 15 where they are crossed over by the gas following the bullet 27 with the velocity of V=650-800 m/s;
- when the gas flows are crossed over in the bore 15, gas braking takes place in the vents row zone 3, the pressure increases and the powder burns down faster;
- the gases exhausting from the barrel bore 16 collide with the increased pressure zone near the vents 3 and rush to the compartments 8-$\mathbf{8}_3$ through the vents row 2;
- when the pressure in the bore 15 decreases due to the bullet 27 movement, the gas from the compartments 8-$\mathbf{8}_3$ rushes to the bore 15 through the vents rows 2 and 3, where it again crosses over the gases exhausting from the bore 16 and slows them down.

A repeated braking of the exhausting gas takes place when the bullet 27 passes through the compartments 9-$\mathbf{9}_3$ and between the muzzle face 12 of the starting part 1 and the muzzle opening 13, where circular braking of the gases is more intensive.

The recoil momentum decrease is achieved due to the gas impact on the front walls of gas vents and compartments, intensive gas flow in the radial direction from the line of fire, and inertia braking of the gases exhausting from the bore. Orientation of gas flows in every radially divided compartment 8, $\mathbf{8}_1$, $\mathbf{8}_2$, $\mathbf{8}_3$, 9, $\mathbf{9}_1$, $\mathbf{9}_2$, $\mathbf{9}_3$ improves the effectiveness of the barrel-mounted device due to the increase of the gas jets velocity impeding gas exhaust from the barrel bore 16. The shot blast and muzzle flash decrease is achieved due to a more complete combustion of powder and the reduction of the velocity of the gas exhaust from the barrel-mounted device. Moreover, perforation 14 on the front wall 11 reduces the intensity of the gas jet exhausting from the muzzle opening 13.

The inventors of this device have determined that while firing with ammunition 7.62×39 and 7.62×51 (.308 Winchester) from small arms fixed in the test bench with shock absorbers, this barrel-mounted device reduces the length of recoil by 12-18 percent. Muzzle flash is practically excluded while firing in the darkness. While firing from the barrel, which has the length of 415 mm, with ammunition 7.62×39, it has been determined that the barrel-mounted device reduces shot blast (sound) by 9.5-11 dB at the distance of 1 m behind the muzzle face. While firing from the barrel, which has the length of 450 mm, with ammunition 7.62×51 (.308 Winchester) it has been determined that the barrel-mounted device reduces shot blast by 12.6-14 dB at the distance of 1 m behind the muzzle face. The difference in relative decrease of shot blast while firing with this ammunition is conditioned by the difference in powder charge weighs. In the ammunition 7.62×39 powder has the weight of $\omega$=1.58 g, and in the ammunition 7.62×51 (.308 Winchester) powder has the weight of $\omega$=2.76 g. The effectiveness of the barrel-mounted device is rising with the increase of the amount of the gas exhausting from the barrel bore. These specifications have been obtained with the casing diameter of 19.6 mm, length of 54 mm and volume of W=162 $cm^3$ (not taking into account the unit for joining to the barrel). In the prototype of this invention (see Description to U.S. Pat. No. 5,136,923) it is written that while firing with the ammunition 5.56×45 shot blast was reduced by 25-38 dB, the casing diameter being 1.75 inches (44.4 mm), the length—8 inches (203 mm) and the volume—W=308.6 $cm^3$. When comparing the indications of the shot blast reduction (ΔP) with the volume of the barrel-mounted device (W), it becomes clear that in this device the indication (ΔP/W) is 3-4 times higher than in the prototype.

In the course of underwater firing with ammunition with an underwater bullet the barrel-mounted device works in the following way:

when the base of an underwater bullet 27 passes through the vents row 2, the gases exhaust to the compartments 8-$\mathbf{8}_3$ filled with water and displace part of the water before the lateral surface of the bullet 27 closes the vents row 2;

when the base of a bullet 27 passes through the vents row 3, the powder gases push the remaining water out of the compartments 8-$\mathbf{8}_3$ through the vents 3 into the bore 15 and the water jets brake the gas, which follows the bullet;

when gas braking takes place in the bore 15, in the vents row zone 3, the pressure increases and the powder burns down faster;

the gases exhausting from the barrel bore 16 collide with the increased pressure zone near the vents 3 and rush to the compartments 8-$\mathbf{8}_3$ through the vents row 2;

when the pressure in the bore 15 decreases due to the bullet 27 movement, the gas from the compartments 8-$\mathbf{8}_3$ rushes to the bore 15 through the vents rows 2 and 3, where it again crosses over the gases exhausting from the bore 16 and slows them down.

A repeated braking of the exhaust gases takes place when the bullet 27 passes through the compartments 9-$\mathbf{9}_3$ and between the muzzle face 12 of the starting part 1 and the muzzle opening 13, where a more intensive circular braking of gas by a circular water flow takes place.

The reduction of recoil momentum is achieved through the gas and water influence upon the front walls of vents and compartments, an intensive gas and water flow in the radial direction from the line of firing, and through inertial braking of the gas exhausting from the bore. Perforation 14 in the front wall 11 decreases the intensity of the gas jet exhausting from the muzzle opening 13.

While firing in the air and under the water with ammunition 7.62×39 and 7.62×51 with an underwater bullet, which has the mass of 14-15 g, from small arms fixed in the test bench with shock absorbers, it has been determined that this barrel-mounted device reduces the length of recoil under the water by 10-15 percent more than in the air. The difference in the recoil length is explained by the fact that, despite the additional volume of the water pushed out of the barrel, the effectiveness of the barrel-mounted device increases due to the gas hydrodynamic braking.

In the course of underwater firing it has been determined that the barrel-mounted device considerably reduces the hydraulic blow affecting the shooter. Video recording helped to find out that the hydraulic blow is reduced in the following way:

when an underwater bullet (cavitating core) is ejected from the barrel-mounted device, a certain amount of gas is temporarily braked by the barrel-mounted device and is located in the barrel, and the cavitating core moves in the water and forms a cavern (vacuum tunnel);

when the core is 2-3 meters away from the barrel, the gases exhaust from the barrel and fill the cavern, and at the distance of 1-1.5 meters from the barrel a gas bubble is formed, which has a weak hydraulic affect on the shooter because of its remoteness.

Twin longitudinal displacement of the compartments 8 and $\mathbf{8}_2$, as well as 9 and $\mathbf{9}_2$, relative to the compartments $\mathbf{8}_1$ and $\mathbf{8}_3$, as well as $\mathbf{9}_1$ and $9_3$, and the gas vents of these compartments to the length of 0.2-0.3 L makes possible an additional increase of the barrel-mounted device effectiveness due to the extension of the hydrodynamic and/or gas-dynamic braking zone.

It should be noted that under powerful heating in the course of intensive firing from combat small arms, air defense gun system and gun armament in the air, the effectiveness of the barrel-mounted device grows due to the increase of the gas flow velocity in the compartments. At the same time it should be taken into account that the barrel-mounted device reduces recoil momentum, hence it is necessary to check the possibility of using the device in weapon systems the automatic mechanisms of which work due to the barrel recoil.

A similar construction of the barrel-mounted device can be used in smoothbore sporting, hunting and combat shotguns for firing in the air with bullets and small shots as well as for underwater firing with underwater bullets. While firing in the air, the circular gripping gas influence on the shot shell in the clearance between the muzzle face 12 of the starting part 1 and the muzzle opening 13 provides proportional distribution and high close grouping of shots in the record target. To increase the effective range of firing with small shots a standard muzzle taper with the minimal diameter of $D_C$=0.95-0.98 $D_2$ can be made in the bore 15 between the gas vents 4 and the muzzle face 12.

The inventors of the device have determined that while firing from 12-gauge shotguns with the diameter of the starting part bore 15 $D_2$=18.2-18.5 mm with shots, using the device of a similar design shown in FIG. 1 and FIG. 2 but with a muzzle taper of $D_C$=0.97 $D_2$ (half-choke), fire accuracy of at least 65 percent is ensured, which corresponds to the fire accuracy while firing from standard shotguns with small shots without the device, but with a muzzle taper of $D_C$=0.94 $D_2$ (choke).

Figure 3:
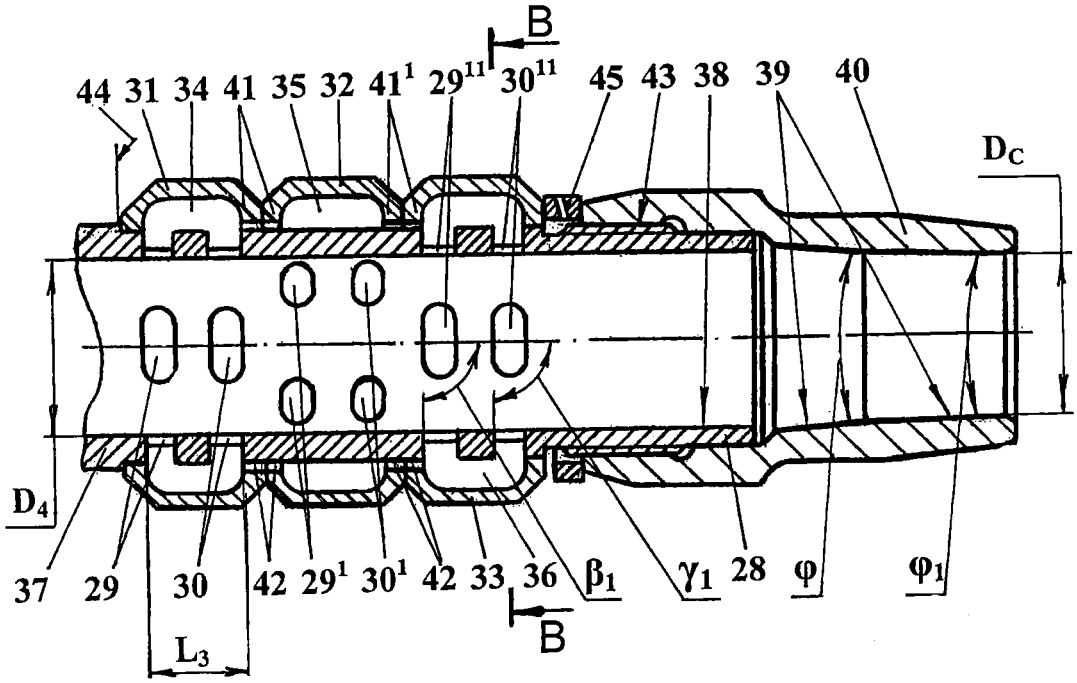
FIG. 3 and FIG. 4 show the second embodiment of the invention in a barrel-mounted device of a smooth bore firearm with a replaceable muzzle taper.
Figure 4:
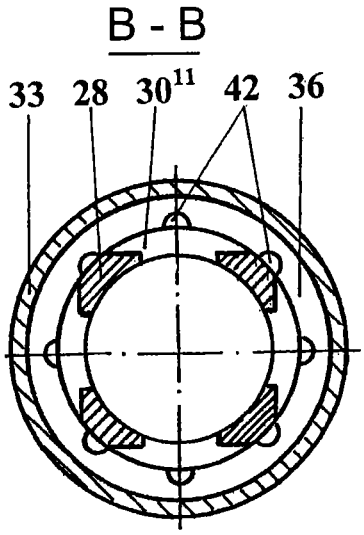

FIG. 3 and FIG. 4 show the barrel-mounted device of a 12 gauge shotgun with a muzzle taper, and FIG. 3 shows the axial longitudinal section of the device, and FIG. 4 shows the device cross-section in the plane B-B.

The barrel-mounted device comprises a starting part 28 with twenty four gas vents arranged into transversal rows 29, $\mathbf{29}^1$, $\mathbf{29}^{11}$, 30, $\mathbf{30}^1$, $\mathbf{30}^{11}$ and a casing consisting of three bodies 31, 32 and 33. Each body contains one compartment 34, 35 and 36, and each compartment includes two gas vents rows 29 and 30, $\mathbf{29}^1$ and $\mathbf{30}^1$, $\mathbf{29}^{11}$ and $\mathbf{30}^{11}$ which are located in the opposite sides of compartments. The starting part 28 is placed in the muzzle 37 of a smooth-bore gun, and the smooth-bore 38 of the starting part 28 has a muzzle taper 39 in the replaceable muzzle device 40. The walls 41 and $\mathbf{41}^1$ of the compartments have perforation 42 to let part of the gas or water exhaust into adjacent compartments. And the bodies 31, 32 and 33 are mounted with a possibility of turning around the longitudinal axis of the starting part 28 and overlapping perforation 42. The mounting attachment of the barrel-mounted device comprises a threaded joint 43 of the replaceable muzzle device 40 with a starting part 28, a thrust surface 44 and an elastic cut washer 45.

The diameter of the bore 38 of the starting part 28 corresponds to the diameter of a 12-gauge shotgun barrel and is equal to $D_4$=18.2-18.6 mm, and the area of its cross-section is equal to $S_4$=260-270 $mm^2$. The total area of four gas vents in each row, measured from the bore side 38 is equal to $S_5$=0.35 $S_4$. The angle between the walls of the gas vents and the vertical axis of the bore is $\beta_1=\gamma_1$=90 degrees. The length of each compartment is $L_3$=0.8 $D_4$. In the cross-section plane of the barrel-mounted device the axis of gas vents in the rows 29$^1$ and 30$^1$ have a 45-degree offset relative to the axis of gas vents in the rows 29 and 30, 29$^{11}$ and 30$^{11}$, which improves the gas-dynamic braking. In the cross-section plane of the barrel-mounted device the minimal area of each compartment, designed for the gas flow between the gas vents rows 29 and 30, or 29$^1$ and 30$^1$, or 29$^{11}$ and 30$^{11}$ is equal to $S_6$=0.65 $S_4$, and the total area of perforation in each wall is equal to $S_7$=0.25 $S_4$. The minimal diameter of the muzzle taper 39 of the starting part 28 bore 38 is equal to $D_C$=0.97 $D_4$.

While firing in the air it is reasonable to overlap perforation 42 by the turn of the body 32 around the starting part 28. Then the barrel-mounted device works in the following way:

- when the base of a bullet or a shot shell passes through the vents row 29, the gases exhaust to the compartment 34 and speed up to U=1800-2400 m/s at free expansion
  - when the base of a bullet or a shot shell passes through the vents row 30, the gases from the compartment 34 are redirected by the wall 41 and rush through the row of vents 30 to the bore 38 where they are crossed over by the gas following the bullet or the shot shell with the speed of V=400-500 m/s;
  - when the gas flows are crossed over in the bore 38 gas braking takes place in the vents row zone 30, the pressure increases and the powder burns down faster;
  - the gases exhausting from the barrel bore 37 collide with the increased pressure zone near the vents 30 and rush to the compartment 34 through the vents row 29;
  - when the pressure in the bore 38 decreases due to the bullet or shot shell movement, the gas from the compartment 34 rushes to the bore 37 through the vents rows 29 and 30, where it again crosses over the gases exhausting from the bore 37 and slows them down.

A repeated braking of the gas takes place when the bullet or the shot shell passes through the compartments 35 and 36.

The recoil momentum decrease is achieved due to the powder gas impact on the front walls of gas vents and compartments, intensive gas flow in the radial direction from the line of fire, and inertia braking of the gases exhausting from the bore. The shot blast and muzzle flash decrease is achieved due to a more complete combustion of powder and the reduction of the velocity of the gas exhaust from the barrel-mounted device Moreover, while firing in the air the shots dispersion characteristics depend on the design of the muzzle taper. In smooth-bore weapon the muzzle taper is usually formed by two adjoined conical surfaces with the angle of $\phi$=4-5 degrees and the angle of $\phi_1$=0.25-0.5 degrees, and sometimes it may have a parabolic surface. The inventors of the device have determined that the accuracy of fire increases by 15-20 percent while firing with shot shells using this barrel-mounted device in standard shotguns with a standard muzzle taper 39.

While firing under the water it is reasonable to open perforation 42 by the turn of the body 32 around the starting part 28. Then the barrel-mounted device works in the following way:

- when the base of an underwater bullet passes through the vents row 29, the gases exhaust to the compartment 34 filled with water, but as the vents row 30 is already closed by the lateral surface of the underwater bullet, part of the water is pushed out to the next compartment through perforation 42;
- when the base of a bullet passes through the vents row 30, the gases push the water remaining in the compartment through the vents row 30 into the bore 38 and the water jets brake the gas, which follows the bullet;
- when gas braking takes place in the bore 38, in the vents row zone 30, the pressure increases and the powder burns down faster;
- the gases exhausting from the barrel bore 37 collide with the increased pressure zone near the vents 30 and rush to the compartment 34 through the vents row 29;
- when the pressure in the bore 38 decreases due to the bullet movement, the gas from the compartment 34 rushes to the bore 38 through the vents rows 29 and 30, where it again crosses over the powder gas exhausting from the bore 37 and slows it down.

A repeated braking of the exhausting gas by water jets takes place when the bullet passes through the compartments 35 and 36. Moreover, when the underwater bullet passes through the vents row 29$^1$, the gas pushes the water from the compartment 35 through perforation 42 to the adjacent compartments 34 and 36. When the underwater bullet passes through the vents row 29$^{11}$, the gas pushes the water out of the compartment 36 through the perforation 42 to the adjacent compartment 35.

The inventors of this device have determined that while firing under the water from a .410 bore shotgun this barrel-mounted device works and reduces the hydraulic blast wave in the same way as the barrel-mounted device shown in FIG. 1 and FIG. 2.

This design of the barrel-mounted device calls for updating the muzzle of the existing weapons, which can be carried out in workshops. It is reasonable to produce new weapon with the barrel-mounted device. The advantage of this design is the ease of manufacturing, as a muzzle is used in the starting part. Besides, the weight, dimensions and balance of shotguns are not changed, but all the positive qualities of the barrel-mounted device are provided.

Moreover, the barrel-mounted device of this design with the preferable muzzle taper 39 of $D_C$=0.97-0.98 $D_2$ can be produced separately and fixed on the barrel 37 with a threaded joint 38 instead of a muzzle adapter 40.

Figure 5:
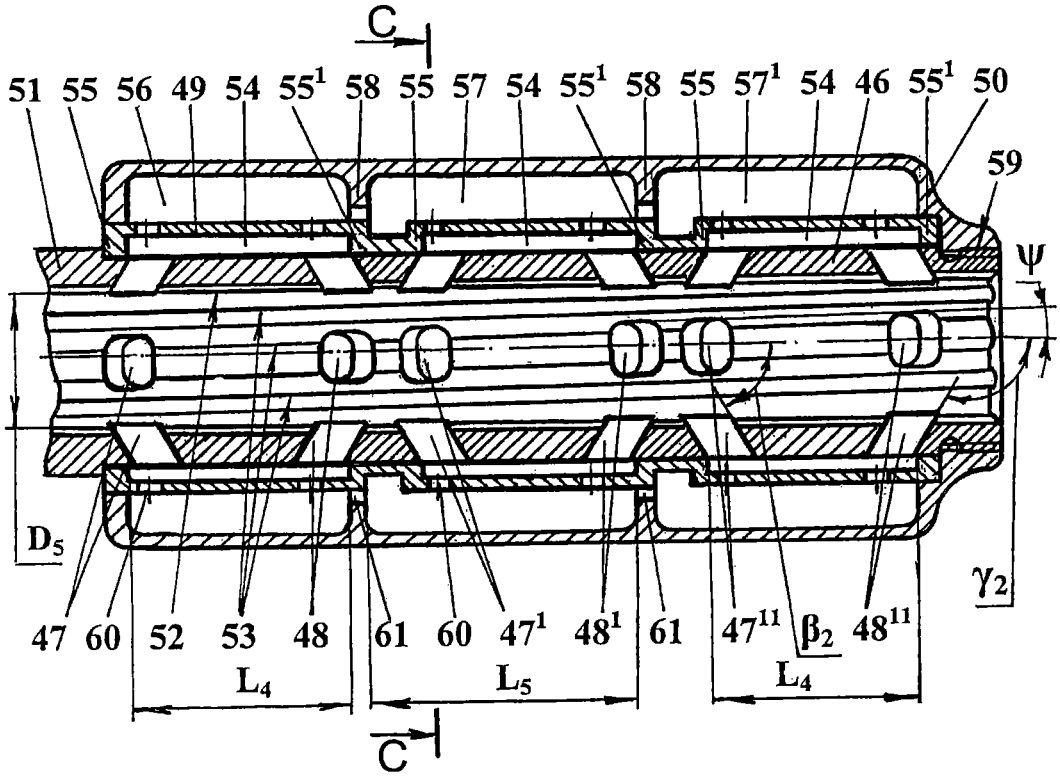
FIG. 5 and FIG. 6 show the third embodiment of the invention in a barrel-mounted device of a rifled large-caliber firearm.
Figure 6:
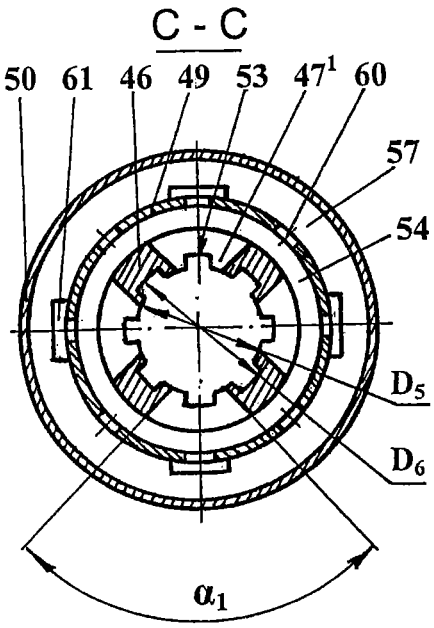

FIG. 5 and FIG. 6 show the barrel-mounted device of a 12.7-mm caliber rifled barrel, where FIG. 5 shows the axial longitudinal section of the device, and FIG. 6 shows the device cross section in the plane C-C.

The barrel-mounted device comprises a starting part 46 with twenty four gas vents arranged into transversal rows 47, 48, 47$^1$, 48$^1$, 47$^{11}$ 48$^{11}$, a perforated casing 49 and an outer housing 50. The starting part is placed in the muzzle of a rifled barrel 51, and the bore 52 of the starting part 46 has rifling grooves 53, and the geometry of gas vents rows is to be matched with their profile. Three compartments 54 with cross walls 55 and 55$^1$are formed between the casing 49 and the starting part. Three compartments 56, 57 and 57$^1$ with perforated adjacent walls are formed between the casing and the housing 50. Each compartment 54 includes two rows of gas vents 47 and 48, 47$^1$ and 48$^1$, 47$^{11}$ and 48$^{11}$. The housing 50 with a perforated casing has a threaded joint 59 with the starting part 46.

The barrel bore 51, as well as the starting part 46 bore 52 have the caliber of $D_5$=12.7 mm, which corresponds to the barrel bore diameter measured at rifling lands, and the barrel bore diameter measured at the bottom of grooves equals to $D_6$=13.0 mm. The bore has eight rifling grooves, each 2.8 mm wide, and the cross-section area of the rifled bore is $S_8$=132 $mm^2$. The total area of four gas vents in each row, measured from the side of the bore 52, equals to $S_9$=1.4 $S_8$. In the gas vents rows 47, 47[1] and 47[11] the angle between the vents walls and the longitudinal axis of the starting part bore is $\beta_2$=60 degrees, and in the gas vents rows 48, 48[1] and 48[11] the angle between the vents walls and the longitudinal axis of the starting part bore is $\gamma_2$=120 degrees. The angle between side walls of gas vents is $\alpha_1$=90 degrees. The gas vents are oriented along the rifling grooves 53. The barrel twist equals to H=381 mm, and the inclination of the grooves equals to 6 degrees, so the side walls of gas vents in each row have a $\psi$=6-degree offset relative to the side walls of the previous row gas vents. Thus the undamaged condition of the profile of four rifling grooves out of the eight and a stable movement of a bullet in the starting part 46 bore 52 are ensured in the gas vents zone. The length of the compartments 54 and 56 is $L_4$=2.1 $D_5$, and the length of the compartments 57 and 57[1] is $L_5$=2.3 $D_5$. In the cross-section plane of the barrel-mounted device the area of the compartments 54, designed for the gas flow between the gas vents rows 47 and 48 or 47[1] and 48[1], or 47[11] and 48[11], is equal to $S_{10}$=0.8 $S_8$, and the area of the compartments 56 and 57, designed for the gas flow between the outer lateral surface of the casing 49 and the inner lateral surface of the housing 50 is equal to $S_{11}$=4.3 $S_8$. In each compartment 54 the total area of perforation 60 in the casing 49 is equal to $S_{12}$=0.5 $S_8$, and the total area of perforation 61 in each adjacent wall 58 is equal to $S_{13}$=0.35 $S_8$.

While firing in the air, the barrel-mounted device works in the following way:

- when the base of a bullet passes through the vents row 47, the gases exhaust to the compartment 54, and part of the gases is discharged to the compartment 56 through the casing 49 perforation 60. In the compartments 54 and 56 the expanding gas speeds up to U=1800-2400 m/s;
- when the base of a bullet passes through the vents row 48, part of the gases penetrates into the next compartment 57 through the perforation 61 of the wall 58, and through the perforation 60 of the casing 49 it penetrates into the next compartment 54 and is cooled in those compartments. The major portion of the gases is redirected by the wall 55[1] and rushes through the row of vents 48 to the bore 52 where it is crossed over by the gas following the bullet with the velocity of V=800-950 m/s;
- when the gas flows are crossed over in the bore 52, gas braking takes place in the vents row zone 48, the pressure increases and the powder burns down faster;
- the gases exhausting from the barrel bore 51 collide with the increased pressure zone near the vents 48 and rush to the compartments 54 and 56 through the vents row 47;
- when the pressure in the bore 52 decreases due to the bullet movement, the gas from the compartments 54 and 56 rushes to the bore 52 through the vents rows 47 and 48, where it again crosses over the gases exhausting from the bore 51 and slows them down.

A repeated braking of the exhausting gas takes place when the bullet passes through the subsequent compartment, and part of the gas is cooled in the compartments 56 and 57.

The recoil momentum decrease is achieved due to the gas impact on the front walls of gas vents and the walls of compartments, intensive gas flow in the radial direction from the line of fire, and inertia braking of the gases exhausting from the bore. The shot blast and muzzle flash decrease is achieved due to a more complete combustion of powder, cooling of the part of the gas in the compartments 56-57[1] and the reduction of the velocity of the gas In the course of underwater firing the barrel-mounted device works in the following way:

- when the base of an underwater bullet passes through the vents row 47, the gases exhaust to the compartment 54 filled with water and displace part of the water before the lateral surface of the bullet closes the vents row 48. Moreover, part of the gasses is discharged through the casing 49 perforation 49 to the compartment 56 filled with water, and through the wall 58 perforation 61 the water is pushed out to the compartment 57. Then the water is pushed out to the next compartments 54 and 57 through the casing 49 perforation 61 and escapes through the vents to the bore 52.
- when the base of a bullet passes through the vents row 48, the powder gases push the remaining water out of the compartments 54 and 56 through perforation 60 and a row of vents 48 into the bore 52, and the water jets brake the gas, which follows the bullet;
- when gas braking takes place in the bore 53, in the vents row zone 48, the pressure increases and the powder burns down faster;
- the gases exhausting from the barrel bore 51 collide with the increased pressure zone near the vents 48 and rush to the compartments 54 and 56 through the vents row 47;
- when the pressure in the bore 52 decreases due to the bullet movement, the gas from the compartments 54 and 56 rushes to the bore 51 through the vents rows 47 and 48, where it again crosses over the gases exhausting from the bore 51 and slows them down.

A repeated braking of the gas exhausting from the barrel bore takes place when a bullet passes through the subsequent compartments.

The recoil momentum decrease is achieved due to the gas impact on the front walls of gas vents and the front walls of compartments, intensive gas and water flow in the radial direction from the line of fire, as well as inertia braking of the gases exhausting from the bore by water jets. The hydraulic impact decrease is achieved due to the cooling of the part of the gas in the compartments 56-57[1] and the reduction of the velocity of the gas exhaust from the barrel-mounted device.

This design of the barrel-mounted device calls for updating the muzzle of the existing weapons, which can be carried out in workshops. It is reasonable to produce new weapon with the barrel-mounted device. The main advantage of this design is that a muzzle of a rifled or a smooth bore is used in the starting part, so the weight, dimensions and balance of weapons are practically not changed, the decrease of the accuracy of fire and of the shoot is impossible, but all the positive qualities of the barrel-mounted device are provided.

A similar construction of the barrel-mounted device can be used in smoothbore shotguns. Moreover, there is no need in matching gas vents with the rifling grooves of the starting part bore, and the muzzle face can have an additional muzzle taper after the gas vents row 48[11]. The inventors of this device have determined that the use of the design of a perforated casing 49 with an additional housing 50, shown in FIG. 5 and FIG. 6, in the design of a 12 gauge shotgun, shown in FIG. 3 and FIG. 4, makes it possible to reduce sound blast when firing with a hunting ammunition with shots or a bullet by 28-33 dB. Moreover, the use of the design of a barrel-mounted device, shown in FIG. 5 and FIG. 6, in a .410 bore shotgun while firing under the water ensures a considerable reduction of hydraulic impact in comparison with the barrel-mounted device, shown in FIG. 1 and FIG. 2.

Figure 7:
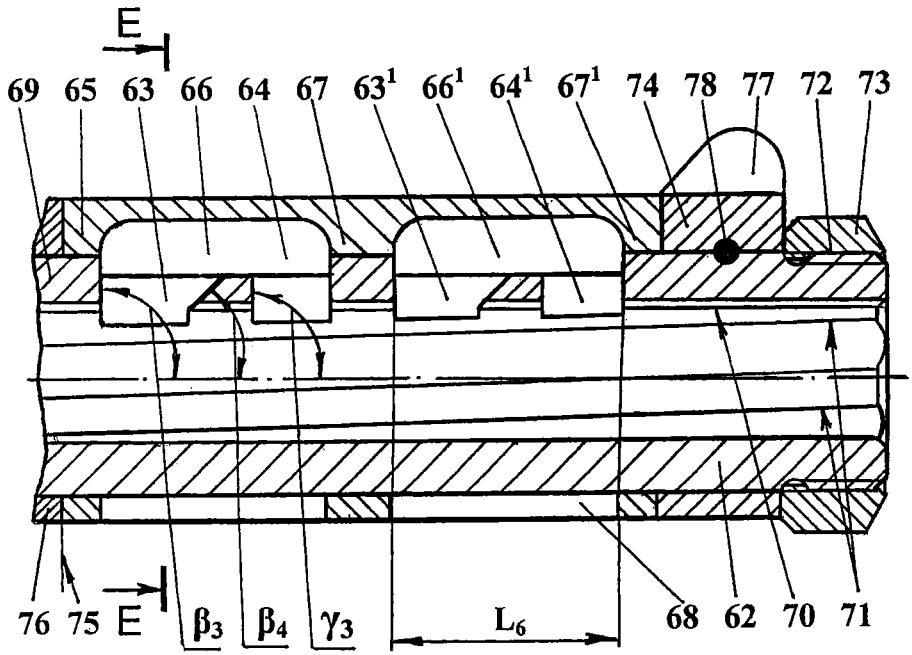
FIG. 7 and FIG. 8 show the fourth embodiment of the invention in a barrel-mounted device of a rifled firearm.
Figure 8:
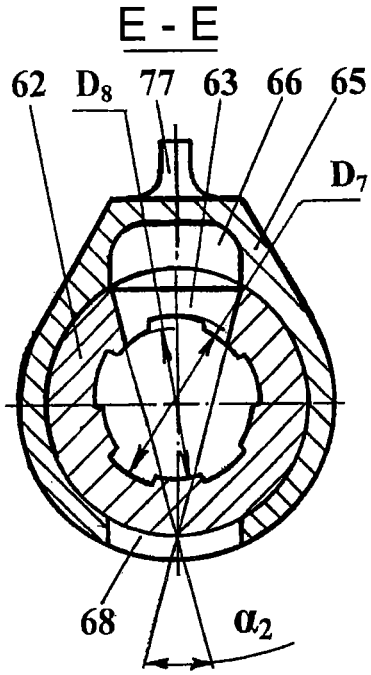

FIG. 7 and FIG. 8 show the barrel-mounted device of the rifled barrel of a .357 caliber revolver Magnum, where FIG. 7 shows the axial longitudinal section of the device, and FIG. 8 shows the device cross-section in the plane E-E.

The barrel-mounted device comprises a starting part 62 with four gas vents 63, 64, 63$^1$, 64$^1$ and a casing 65 with two compartments 66, 66$^1$, which have walls and operational slots 68. Each compartment includes two gas vents 63 and 64, 63$^1$ and 64$^1$ located on the opposite sides of the compartment. The starting part 62 is in the muzzle of a rifled barrel 69, and the bore 70 of the starting part 62 has five rifling grooves 71, and the geometry of gas vents rows is to be matched with their profile. The mounting attachment of the barrel-mounted device comprises a threaded joint 72 of the barrel nut 73 with the starting part 62, a front-sight body 74 and a thrust surface 75 of the barrel casing 76. A vertical orientation of the front-sight 77 is ensured by a screw 78.

The barrel bore 69, as well as the starting part 62 bore 70 have the caliber of .357 ($D_7$=9.06 mm), which corresponds to the barrel bore diameter measured at the bottom of grooves, and the barrel bore diameter measured at the rifling lands equals to $D_8$=8.79 mm. The bore has five rifling grooves, each 2.8 mm wide, and the cross-section area of the rifled bore is $S_{14}$=62.5 mm$^2$. The length of compartments 66 and 66$^1$ is $L_6$=2.3 $D_7$. The each gas vent, measured from the side of the bore 70, equals to $S_{15}$=0.4 $S_{14}$. In the cross-section plane of the barrel-mounted device the area of each compartment 66 and 66$^1$, designed for the gas flow between the gas vents rows 63 and 64 or 63$^1$ and 64$^1$, is equal to $S_{10}$=0.8 $S_8$, and the area of the compartments 56 and 57, designed for the gas flow between the outer lateral surface of the casing 49 and the inner lateral surface of the housing 50 is equal to $S_{16}$=0.5 $S_{14}$. The angle between side walls of gas vents is $\alpha_2$=30 degrees. The angles between side walls of gas vents are $\beta_3$=$\gamma_3$=90 degrees and $\beta_4$=45 degrees. The gas vents are oriented along the rifling grooves 71. The barrel twist in the .357 caliber revolver equals to $H_1$=18 inch=457 mm, and the inclination of the grooves equals to 3.5 degrees, so the side walls of the gas vents 63$^1$ and 64$^1$ have a $\psi$=3.5-degree offset relative to the side walls of the previous gas vents 63 and 64. Thus the undamaged condition of the profile of four rifling grooves out of the five and a stable movement of a bullet in the starting part 62 bore 70 are ensured in the gas vents zone.

While firing in the air, the barrel-mounted device works in the following way:

- when the base of a bullet passes through the vent 63, the gases exhaust to the compartment 66 and speed up to U=1800-2400 m/s at free expansion;
- when the base of a bullet passes through the vent 64, the gases from the compartment 66 are redirected by the wall 67 and rush through the vent 64 to the bore 70 where they are crossed over by the gas following the bullet with the velocity of V=280-450 m/s;
- when the gas flows are crossed over in the bore 70, gas braking takes place in the vent 64, the pressure increases and the powder burns down faster;
- the gases exhausting from the barrel bore 69 collide with the increased pressure zone near the vent 64 and rush to the compartment 66 through the vent 63;
- when the pressure in the bore 70 decreases due to the bullet movement, the gas from the compartment 66 rushes to the bore 70 through the vents 63 and 64, where it again crosses over the gases exhausting from the bore 9 and slows them down.

A repeated braking of the exhausting gas takes place when a bullet passes through the compartment 66$^1$.

The recoil momentum decrease is achieved due to the gas impact on the front walls of gas vents and the walls of compartments, intensive gas flow in the radial direction from the line of fire, as well as inertia braking of the gases exhausting from the barrel. Orientation of gas flows in every compartment improves the effectiveness of the barrel-mounted device due to the increase of the gas jets velocity impeding gas exhaust from the barrel bore 69. The shot blast and muzzle flash decrease is achieved due to a more complete combustion of powder and the reduction of the velocity of the gas exhaust from the barrel-mounted device.

In the course of underwater firing with ammunition with an underwater bullet the barrel-mounted device works in the following way:

- when the base of an underwater bullet passes through the vent 63, the gases exhaust to the compartment 66 filled with water and displace part of the water before the lateral surface of the bullet closes the vent 64;
- when the base of a bullet passes through the vent 64, the powder gases push the remaining water out of the compartment 66 through the vent 64 into the bore 70 and the water jets brake the gas, which follows the bullet;
- when gas braking takes place in the bore 70, in the vent zone 64, the pressure increases and the powder burns down faster;
- the gases exhausting from the barrel bore 69 collide with the increased pressure zone near the vent 64 and rush to the compartment 66 through the vent 63;
- when the pressure in the bore 70 decreases due to the bullet movement, the powder gases from the compartment 66 rush to the bore 70 through the vents 63 and 64, where they again cross over the gases exhausting from the bore 69 and slow them down.

A repeated braking of the exhausting gas takes place when a bullet passes through the compartment 66$^1$.

The recoil momentum decrease is achieved due to the gas and water impact on the front walls of gas vents and the walls of compartments, intensive gas and water flow in the radial direction from the line of fire, as well as inertia braking of the gases exhausting from the barrel.

This design of the barrel-mounted device calls for updating the muzzle of the existing revolvers, which can be carried out in workshops. It is reasonable to produce new weapon with the barrel-mounted device. The main advantage of this design is that a muzzle of a rifled bore is used in the starting part, and the weight, dimensions and balance of the revolver are practically not changed, the decrease of the accuracy of fire and of the shoot is impossible; moreover, all the positive qualities of the barrel-mounted device are provided. Besides, it is reasonable to use this design of the barrel-mounted device in double-barrel sporting and hunting shotguns, where compartments are to be placed between the barrels not to disturb the appearance, weight and balance of the weapons.

While firing with ammunition .357 Magnum from a revolver, fixed in the test bench with shock absorbers, it was determined that this barrel-mounted device reduces the length of recoil by 10-12 percent. Muzzle flash is practically excluded while firing in the darkness. The shot blast (sound) reduction depends on the power of ammunitions used, and at the distance of 1 m behind the muzzle face it makes up 3.5-4.2 dB. To increase the effectiveness of this device it is reasonable to use additionally the design of the device, shown in FIG. 1 and FIG. 2, and to attach it with the help of a threaded joint 72 instead of the barrel nut 73.

INDUSTRIAL APPLICABILITY

The invention will find its application in barrel-mounted devices for the barrels of rifled and smoothbore firearms.

The design of barrel-mounted devices according to the invention may be used in small arms as well as in rifled and smoothbore sporting and hunting guns for firing in the air and under the water with caliber and sub-caliber bullets with a discarding sabot. Moreover, the practicability of firing under the water is determined for each weapon system separately. The design of barrel-mounted devices according to the invention may be used in smoothbore guns of any gauge for firing in the air with a bullet or a shot shell, as well as in artillery weapon of any caliber for firing in the air with caliber and sub-caliber projectiles with a discarding sabot.

The invention claimed is:

1. A barrel-mounted device in combination with a firearm comprising: a unit for joining to the barrel, a casing and a starting part with gas vents, and wherein a starting part bore is the continuation of the barrel/gun bore and there are N≧1 compartments between the casing and the starting part, wherein each compartment includes at least two gas vents and is adapted to ensure gas exhaust from the starting part bore to at least one of the compartments through the first of the mentioned gas vents and gas exhaust from the compartment to the starting part bore through the second gas vent; moreover, the compartment length is 0.5-3.0 of a bore caliber and in every cross-section plane of the barrel-mounted device intersecting at least one compartment the following condition is met:

$$0.4S_K \le \sum_{i=1}^{M} S_i \le 4.5S_K$$

where:

$S_K$ —is the area of the bore;

$S_i$ —is the minimal area of the i-th compartment intended for the gas flow between gas vents;

M —is the number of compartments in the mentioned cross-section plane, 1≦M≦N.

2. The device of claim 1, wherein the gas vents of the starting part are arranged in transversal rows containing not less than two vents each, and the total area of gas vents in every row measured from the side of the starting part bore equals to 0.3-1.5 of the barrel bore cross-section area.

3. The device of claim 1, further comprising an additional muzzle compartment with a front wall, which projects beyond a muzzle face of the starting part and has a muzzle opening; the diameter of the muzzle opening equals to 1.05-1.2 of the barrel bore caliber, and its longitudinal axis coincides with the longitudinal axis of the starting part bore; moreover, the muzzle compartment includes at least one gas vent connecting it with the muzzle opening, and the clearance between the muzzle face of the starting part and the front wall with the muzzle opening is less than the caliber of the barrel bore; moreover in the cross-section plane of the barrel-mounted device the minimal area of the muzzle compartment cross-section intended for the gas passage from the gas vent or vents to the muzzle face of the starting part ranges within 0.4-4.5 of the barrel bore area.

4. The device of claim 1, wherein the angle between the gas vents walls and the longitudinal axis of the starting part bore in the axial-longitudinal-section plane of the barrel-mounted device, measured from the side of the muzzle face of the starting part, ranges within 30-150 degrees, and in the cross-section plane of the barrel-mounted device the angle between the lateral walls of the gas vents ranges within 30-120 degrees.

5. The device of claim 1, wherein each of said N≧1 compartments has at least two cross walls, and one of the at least two gas vents included into the compartment is situated close to the first of the mentioned walls and the second gas vent is situated close to the second of the mentioned walls.

6. The device of claim 5, wherein at least one of said compartments has two longitudinal walls, which restrict the compartment in the longitudinal direction.

7. The device of claim 1, wherein at least one compartment has a perforated partition placed between the lateral surface of the starting part and the inner lateral surface of the casing wherein in a cross-sectional plane of the barrel-mounted device the minimal area intended for the gas passage between the outside lateral surface of the perforated partition and the inner lateral surface of the cased ranges within 0.4-4.5 of the barrel bore cross-sectional area.

8. The device of claim 1, wherein each of said N≧1 compartments has at least two perforated transversal walls.

9. The device of claim 8, wherein said device has the option of closing perforation in the transversal walls of adjacent compartments.

10. The device of claim 1, wherein perforation is made in the walls of adjacent compartments of the additional outer housing.

11. The device of claim 1, wherein the starting part bore, which is the continuation of the rifled bore, is made smooth and its diameter is equal to 1.01-1.06 of the rifled bore diameter measured at rifling lands.

12. The device of claim 1, wherein the starting part bore has rifling grooves, which are the continuation of the bore rifling grooves, the gas vents being directed along the grooves bottom wherein if said bore has more than five rifling grooves the number of vents in each row does not exceed half of the grooves and at least half of the grooves are situated between the vents.

13. The device of claim 12, wherein the starting part is made in the muzzle of a rifled barrel and the muzzle face of the starting part fits the muzzle face of the barrel.

14. The device of claim 1, wherein the starting part bore is made smooth and its diameter is equal to 0.99-1.03 of the smooth bore diameter.

15. The device of claim 14, wherein the starting part bore has a muzzle taper, the minimal diameter of which is equal to 0.95-0.98 of the diameter of the starting part bore.

16. The device of claim 14, wherein the starting part is made in the muzzle of a smooth bore and the muzzle face of the starting part fits the muzzle face of the barrel.

17. The device of claim 15, wherein the starting part is made in the muzzle of a smooth bore and the muzzle face of the starting part fits the muzzle face of the barrel.

18. The device of claim 1, wherein the casing is multipiece and comprises minimum two elements, and there is not less than one compartment formed between the casing and the starting part, each one including at least two gas vents.

19. The device of claims 1, wherein the starting part is multipiece and comprises minimum two components, which are the continuation of the bore.

20. The device of claim 1, wherein the unit for joining the barrel-mounted device comprises a grip with a conical outer surface and with an external thread and has a nut with a conical inner surface; moreover, the nut is mounted with the possibility of longitudinal movement, impact on the grip conical surface and compressing the grip.

* * * * *